United States Patent [19]

Petersen et al.

[11] 4,091,711

[45] May 30, 1978

[54] ROTARY BOLT LIQUID PROPELLANT GUN

[75] Inventors: Gary L. Petersen; John W. Holtrop, both of Ridgecrest, Calif.

[73] Assignee: The United States of America as represented by the Secretary of the Navy, Washington, D.C.

[21] Appl. No.: 800,751

[22] Filed: May 26, 1977

[51] Int. Cl.[2] ..... F41F 1/04

[52] U.S. Cl. ..... 89/7; 89/13 A; 89/17

[58] Field of Search ..... 89/7, 13 A, 17, 33 MC, 89/13 R; 42/9, 39.5

[56] References Cited

U.S. PATENT DOCUMENTS

| | | | |
|---|---|---|---|
| 38,350 | 4/1863 | Whitcomb | 89/13 A |
| 1,357,513 | 11/1920 | Pettys | 89/7 |
| 3,782,241 | 1/1974 | Ashley | 89/7 |
| 3,997,994 | 12/1976 | Kastner et al. | 42/9 |
| 4,004,363 | 1/1977 | Sackenreuter et al. | 42/9 |
| 4,005,632 | 2/1977 | Holtrop | 89/7 |

FOREIGN PATENT DOCUMENTS

| | | | |
|---|---|---|---|
| 624,405 | 6/1949 | United Kingdom | 89/7 |

*Primary Examiner*—David H. Brown

*Attorney, Agent, or Firm*—R. S. Sciascia; Roy Miller; W. Thom Skeer

[57] ABSTRACT

A liquid propellant gun loading, propellant injection and firing mechanism characterized by a rotating breech block having a generally spherical contour. The breech block is intermittently rotated to and locked in sequential loading, fuel injection and firing positions.

6 Claims, 5 Drawing Figures

ROTARY BOLT LIQUID PROPELLANT GUN

BACKGROUND OF THE INVENTION

1. Field of the Invention

This invention relates to liquid propellant guns and particularly to a novel loading, propellant injection and firing mechanism.

2. Description of the Prior Art.

Generally, liquid propellant guns all contain a mechanism for injecting the propellant. Current designs use injection valves which cannot be exposed to high firing pressures and the injection mechanism is therefore protected from the firing pressures by using a sliding bolt. After injection, for example, the bolt moves forward in the breech, pushing the propellant column and projectile before it down the bore, until a bolt seal is ahead of the injector area. An example of this type of gun is disclosed in assignee's prior application, Ser. No. 612,817 filed Sept. 12, 1975, and now U.S. Pat. No. 3,992,976 issued Nov. 23, 1976. Although this prior design operates satisfactorily, the bolt actuating and locking system is complicated, has high power requirements and slows the rate of fire because of the start and stop action.

SUMMARY OF THE INVENTION

According to the present invention, the propellant injection valve mechanism and the firing device are arranged in space relationship within a rotary breech block in the same general plane with a central bore, orthogonal to the axis of rotation of the block. The breech block also includes an axial liquid propellant transfer arrangement designed to supply a liquid fuel and an oxidizer to the injection valve mechanism. The rotary breech block herein disclosed completely protects the injection system by moving the valve mechanism out of register with the firing chamber before ignition. The rotary breech block mechanism is designed to be moved intermittently through at least 3 sequential positions for loading, injection and firing respectively.

DESCRIPTION OF THE PREFERRED EMBODIMENT

Figure 1:
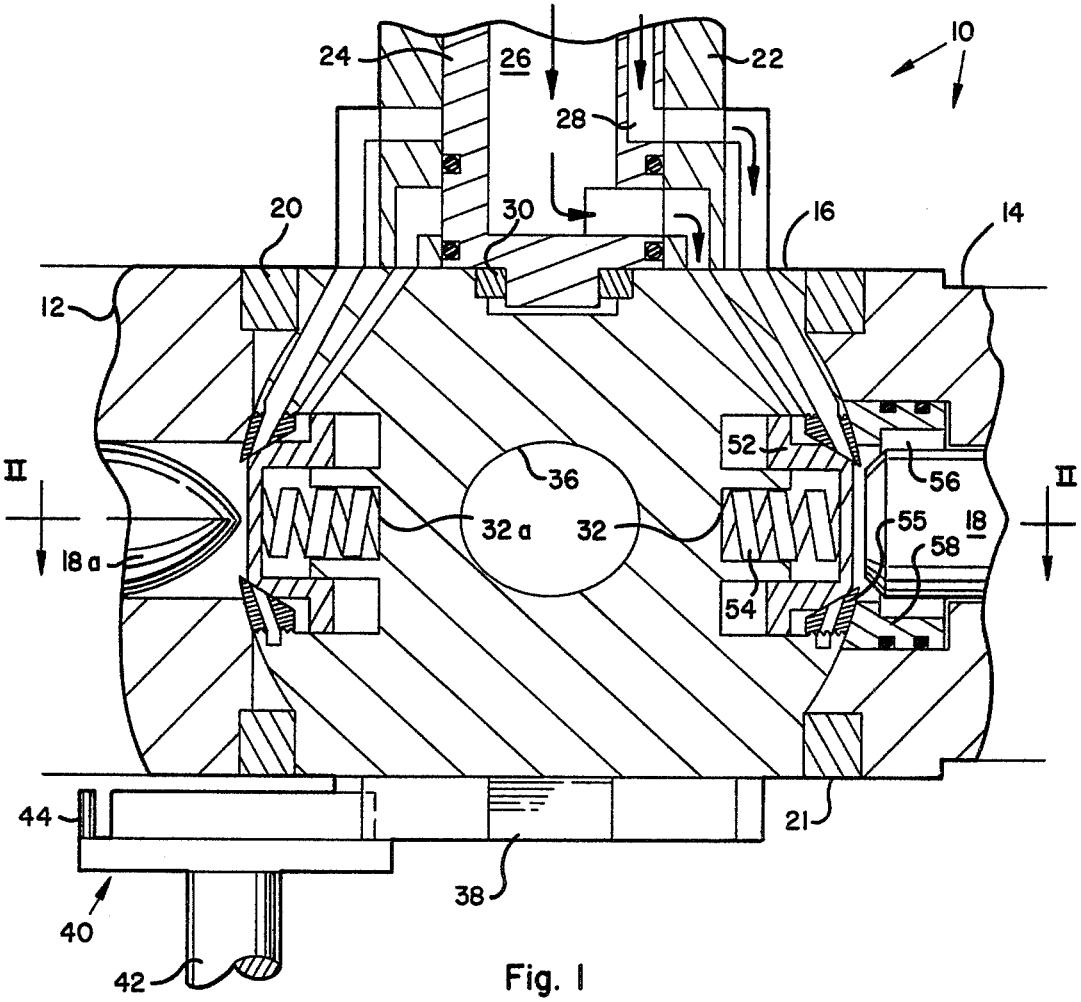
FIG. 1 is a longitudinal cross sectional view in the breech area of a liquid propellant gun according to the present invention.

A rotary bolt liquid propellant gun breech area incorporating the present invention is generally indicated at 10 in FIG. 1. The loading end of the breech area is generally indicated at 12; the barrel is generally indicated at 14; and the rotary breech block is generally indicated at 16. A round 18 is shown in the barrel and a round **18*a*** is shown in the load area.

The rotary breech block 16 is rotatably mounted in the breech area by means of two bearings 20, 21 and receives fuel and oxidizer through a rotary joint between a transfer housing sleeve 22 fixed on the block and a stationary transfer or feed tube 24. In the embodiment illustrated, the feed tube 24 is divided into two separate channels 26, 28 which supply an oxidizer and fuel respectively. The breech block end of delivery tube 24 rests in a bearing 30 fixed in the face of block 16.

Between bearings 20 and 21 the outer surface of breech block 16 is spherical in contour and closely fits within mating concave spherical contours in the loading end 12 and barrel end respectively of breech area 10. In the embodiment shown, block 16 contains two identical poppet valves **32, 32*a*; two identical firing devices 34, 34*a* (see FIG. 3) and a central bore 36**.

Figure 2:
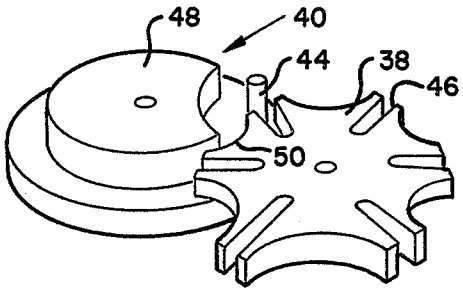
FIG. 2 is a schematic plan view of the drive mechanism of FIG. 1.

The breech block 16 is designed to be driven intermittently and, for this purpose, carries a six lobed geneva wheel 38 integral with the face of breech block 16 opposite feed tube 24, and coaxial thereto. The geneva wheel 38 is driven by a geneva wheel driver 40 which, inturn, may be driven by a constant speed motor (not shown) through shaft 42. FIG. 2 illustrates how a pin 44 on geneva wheel driver 40 cooperates with slots 46 on geneva wheel 38 to intermittently drive wheel 38. Between drive periods, a locking surface or cam 48 cooperates with one of the surfaces 50 between slots on geneva wheel 38 to prevent any movement of wheel 38 during that time.

Figure 3:
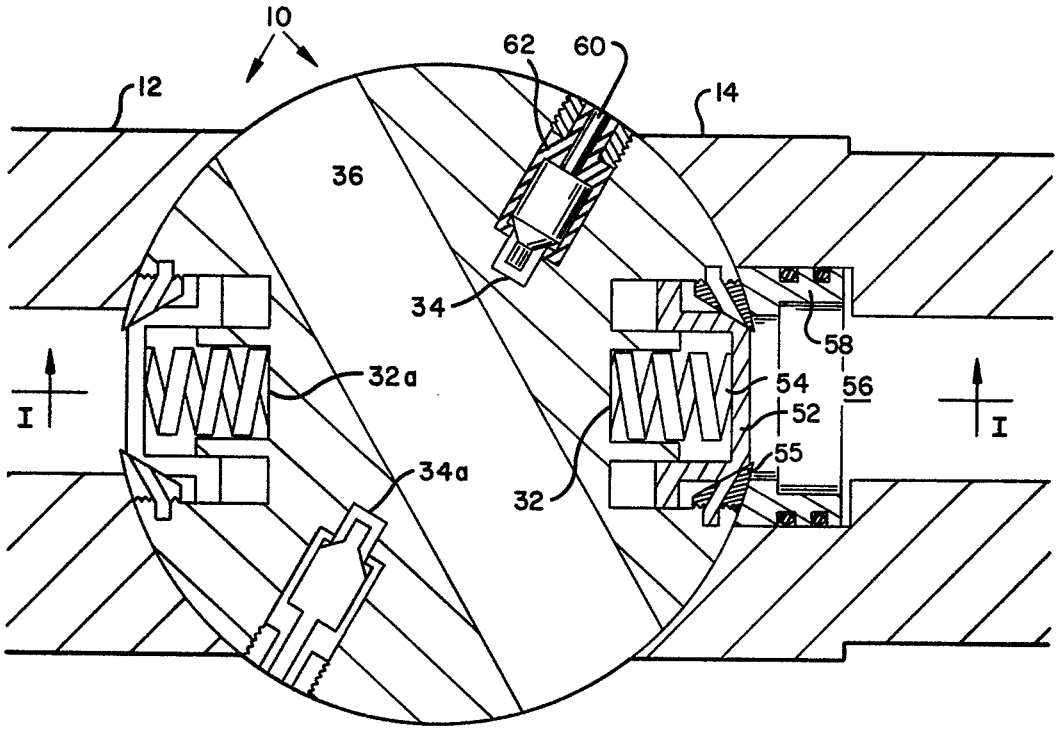
FIG. 3 is a cross sectional view of the FIG. 1 mechanism taken along line II—II.
Figure 4:
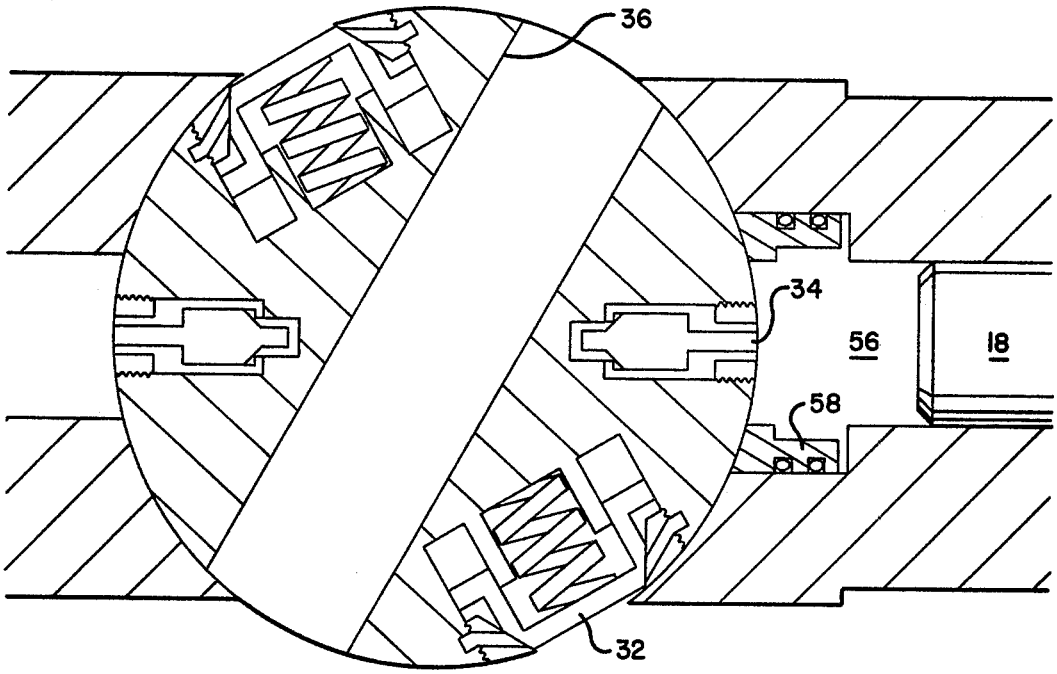
FIG. 4 is a view similar to FIG. 2 showing the rotary bolt in the firing position.

FIGS. 1 and 3 illustrate the device at the beginning of an injection cycle. Valve 32 is in position to receive fuel and oxidizer through ports 26, 28 and when pressure is applied by the fuel and oxidizer the valve body 52 will be pushed back by this pressure against the bias of spring 54 and chamber 56 will be filled with liquid, pushing the round 18 forward in the barrel as shown in FIG. 4. Pressure will also act upon chamber seal 58 to press against the spherical surface of breech block 16.

Figure 5:
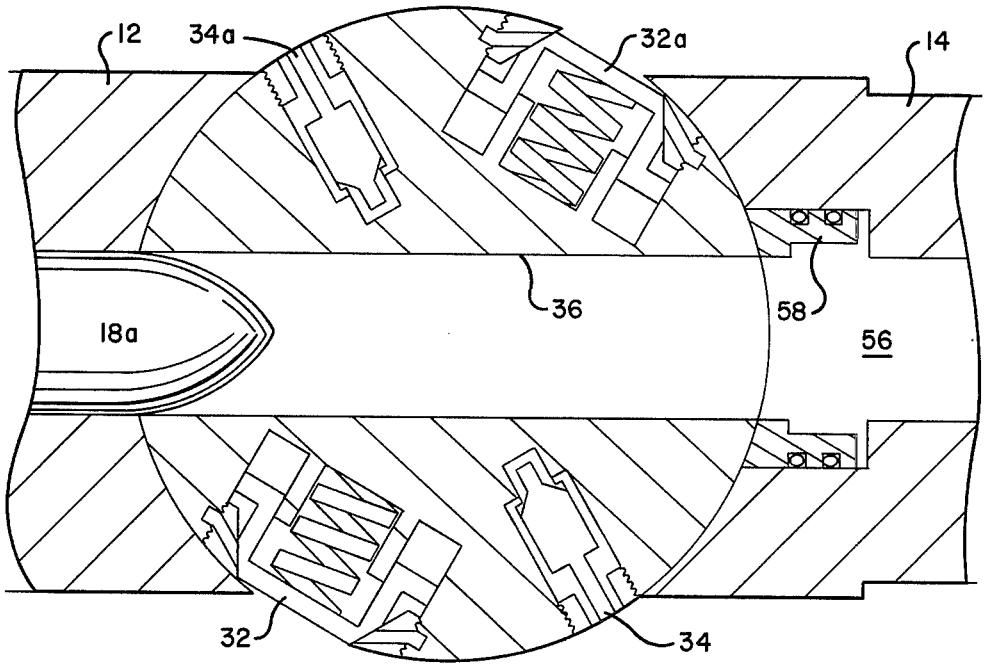
FIG. 5 is a view similar to FIG. 2 with the bolt in the loading position.

After injection of the measured amount of propellant has been accomplished, the breech block is next rotated to the position shown in FIG. 4 with the igniter 34 in position to ignite the fuel in chamber 56, forcing the round 18 out of the barrel. Following this step, the next increment of rotation of block 6 places the parts in the position shown in FIG. 5, allowing the round **18*a* to be advanced through the bore 36 into chamber 56**. This may be accomplished mechanically, for example, by a ram (not shown) or by pneumatic pressure.

The igniter shown in the above embodiment is shown as an electrical spark type but it may, of course, be any type of igniter suitable for the purpose. Similarly, the drive mechanism is shown as a geneva type drive but any intermittent drive which will lock at each position would serve as well. The same rotary breech block concept can be adapted to small or large bore guns.

This invention completely protects the injector mechanism from gun gas pressures at ignition by moving the valve mechanism out of the chamber area before firing. The sealing surfaces consist of easily machined spherical contours and no bolt lock mechanism is required.

For a firing speed of about a thousand rounds per minute, the shaft 42 of the geneva wheel driver rotates at a constant 3,000 revolutions per minute. At this speed, the geneva mechanism will cause the breech block to dwell at each station for about 13 milliseconds. The six lobed geneva wheel and the duplicate valves and igniters are used to reduce breech block acceleration and drive motor power requirements. For slower rates of fire, a three or four station block could be used with a three or four lobed geneva wheel, for example, to further reduce size and increase dwell time at each position.

What is claimed is:

1. A liquid propellant gun breech loading, injection and firing mechanism comprising;

a liquid propellant gun body including a rearward loading portion, a forward barrel portion and a rotatable breech block intermediate said rearward and forward portion;

said gun body having oppositely facing contoured portions between said rearward and forward portion;

said rotatable breech block mechanism comprising contoured surfaces complimentary to said contoured surfaces on said rearward loading and forward barrel portions so that said breech block may be closely confined between said contoured surfaces for rotary motion around an axis perpendicular to the axis of said barrel portion;

said breech block further comprising a fuel transfer housing having a cylindrical inner bore coaxial with said rotational axis for receiving therein a fuel transfer tube;

said breech block further comprising a central bore, at least one injection valve mechanism and at least one firing device each having an axis of symmetry within a plane passing through the barrel axis and perpendicular to the axis of said fuel transfer housing; and means for incrementally moving said breech block to serially position said bore, said injection valve mechanism and said firing mechanism respectively in line and register with said barrel.

2. The apparatus of claim 1 wherein said breech block contains diametrically opposed injector valve mechanisms and two diametrically opposed igniter mechanisms and wherein the axis of symmetry of said injector valve mechanisms and said igniter devices are spaced thirty degrees from the axis of symmetry of said bore and from each other.

3. The apparatus of claim 1 wherein said contoured surfaces of said breech block are substantially spherical.

4. The apparatus of claim 1 wherein said means for incrementally moving said breech block is a six lobed Geneva-type mechanism locking said breech block in six respective positions.

5. The apparatus of claim 4 wherein said breech block contains two diametrically opposed injector valve mechanisms and two diametrically opposed igniter mechanisms and wherein the axis of symmetry of said injector valve mechanisms and said igniter devices are space thirty degrees from the axis of symmetry of said bore and from each other.

6. The apparatus of claim 5 wherein said contoured surfaces of said breech block are substantially spherical.

* * * * *